United States Patent [19]

Beranek

[11] 4,293,130

[45] Oct. 6, 1981

[54] GUARD FOR TENNIS RACKETS AND LIKE ARTICLES

[76] Inventor: Miroslav Beranek, 847 Constitution Dr., Foster City, Calif. 94404

[21] Appl. No.: 11,218

[22] Filed: Feb. 12, 1979

[51] Int. Cl.[3] ..... A63B 49/14

[52] U.S. Cl. ..... 273/73 R

[58] Field of Search ..... 273/67 R, 73 R, 73 C, 273/73 D, 73 H; 24/16 PB, 17 AP, 30.5 P, 201 A, 230 TC, 213 R, 214, 216, 217

[56] References Cited

U.S. PATENT DOCUMENTS

| | | | |
|---|---|---|---|
| 2,361,506 | 10/1944 | Smith | 24/201 A |
| 3,144,695 | 8/1964 | Budwig | 24/16 PB |
| 3,330,560 | 7/1967 | Higdon | 273/73 R |
| 3,597,803 | 8/1971 | Van Neil | 24/16 PB |
| 4,005,864 | 2/1977 | Steward | 273/73 R |
| 4,019,736 | 4/1977 | Lehew | 273/73 R |
| 4,192,506 | 3/1980 | Sofia | 273/73 R |

FOREIGN PATENT DOCUMENTS

| | | | |
|---|---|---|---|
| 2724652 | 12/1978 | Fed. Rep. of Germany | 273/73 R |
| 751040 | 6/1956 | United Kingdom | 273/73 C |

OTHER PUBLICATIONS

"Tennis", Apr. 1978; p. 120.

*Primary Examiner*—Richard J. Apley

[57] ABSTRACT

A guard for a tennis racket or the like for preventing damage to the racket frame if the frame hits the playing surface when the player makes a ground shot. An elongated length of resilient, flexible material is fastened as a loop around the material of the frame at vulnerable points. The guard is readily applied and removed and is of sufficient thickness to serve as a bumper or guard when striking the playing surface.

4 Claims, 4 Drawing Figures

GUARD FOR TENNIS RACKETS AND LIKE ARTICLES

This invention relates to a guard for use on tennis rackets and like articles to prevent damage to the racket frame when the latter strikes an object such as the playing surface.

Heretofore numerous devices have been proposed for protecting the frame of a tennis racket or the like when the racket strikes the playing surface, for example, when the player is making a ground shot. Some such devices have employed a bumper or guard which is secured by means of screws to the racket frame. In addition to adversely affecting the swing weight of the racket such devices weaken the frame and increase the likelihood of the frame splitting.

Another method of protecting the frame has been to wrap a length of light plastic filament around the outer end of the frame in a plurality of windings and tying the ends of the filament. In such cases the light filament is readily broken when the frame scrapes along the playing surface, and it is then necessary to remove the entire filament and replace it with another.

The main object of the present invention is the provision of a racket guard which overcomes the disadvantages of prior art guards of like nature.

Another object of the invention is the provision of a racket guard which is readily applied and removed by the player and which is adapted to afford greater protection than prior art guards having the same object. In this connection it will be understood that a player who has become accustomed to a specific style tends generally to strike the playing surface with the same part of the racket frame, and thus it is unnecessary to provide a guard along a long length of the frame but only at the points where the frame is vulnerable. By the present invention a simple guard is provided which can be applied by the player to suit his style of play and to protect the frame only at vulnerable points.

Other objects and advantages will be apparent from the following specification and from the drawings.

Figure 1:
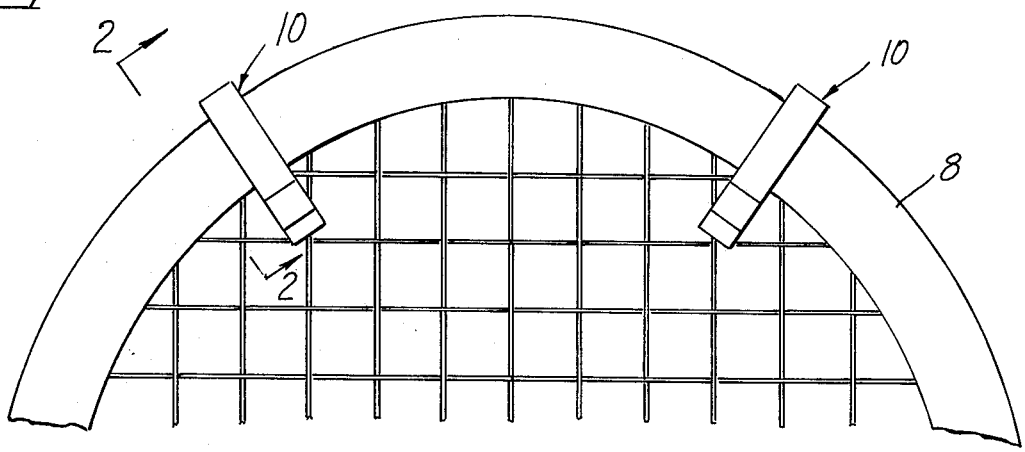
FIG. 1 is a side elevation of the outer end only of a tennis racket showing two guards of the present invention attached to the frame.

In detail, and first with reference to FIG. 1, one or more guards generally designated 10 may be applied to the frame 8 at the outer end of the racket at points which the player considers to be vulnerable to damage.

The guard 10 of FIG. 1 is formed from a strip of resilient, flexible material such as transparent plastic and comprises a central body portion 12 of generally rectangular cross section having opposite sidewalls 14 and opposite end walls 16. At one end the guard 10 is formed with spaced apart cavities 18 providing ridges 20 therebetween.

At the opposite end of the strip 10 the same is formed with a rectangular opening 22 which is adapted to receive the opposite end of the strip therethrough. As best seen in FIG. 3 the depth of the hole 22 is greater than its width and can thus receive the opposite end containing the cavities 18 when said opposite end is twisted about 90° so that the guard may be wrapped around the frame 8 and secured in the manner shown in FIG. 2 with a pair of opposite cavities 18 receiving the material of the strip on opposite sides of the hole 22.

Although the strip 10 has some similarity to certain types of ties which are employed for securing material in place, it is important to note that the present invention requires that the end walls 16 be much wider than in conventional tying strips. For example, as seen in FIG. 3 the thickness of the strip as defined by the sidewall 16 is great enough to permit the strip to act as a bumper as can be seen from FIG. 2. The guard shown has a thickness of about one-half its width which is preferable. Such thickness may be reduced to about one-third the width but the proportions shown are preferable.

Figure 2:
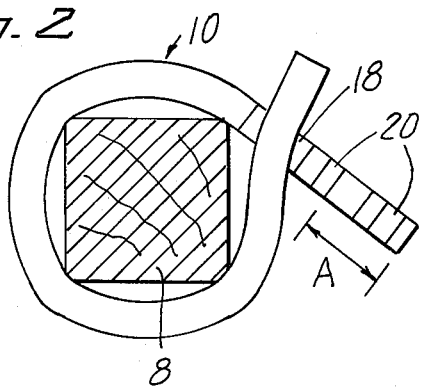
FIG. 2 is a cross sectional view through the material of the frame as taken in a plane indicated by lines 2—2 and showing one guard attached thereto.
Figure 3:
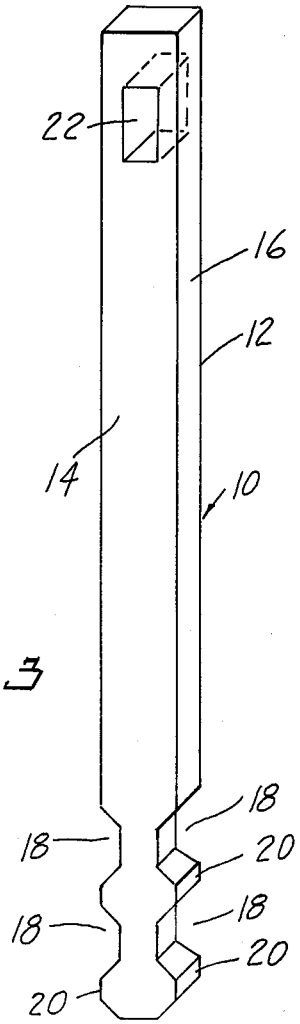
FIG. 3 is a perspective of a preferred form of the invention in its initial condition.

As can be seen in FIG. 2, if the girth of the frame is such that cavities 18 are inwardly of the end of the strip 10 the end portion, such as that indicated at A in FIG. 2, may be cut off.

Figure 4:
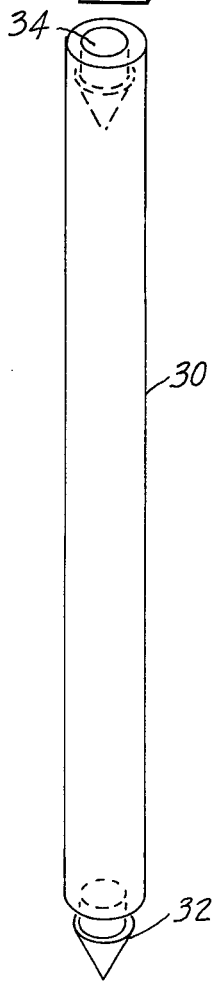
FIG. 4 is a view similar to FIG. 3 showing a modified form of the invention.

Another form of the invention is shown in FIG. 4 wherein a length 30 of plastic circular cross section is employed so that in such case the thickness of the strip is equal to its width. At one end of the guard 30 the same may be provided with an upset end portion 32 which is adapted to be received within a complementarily formed socket 34 at the other end. By using a plastic which may be stretched to some extent it will be apparent that the length 30 may be looped around the frame in a manner similar to that shown in FIG. 1 with the upset end 32 fitted within the complementarily formed socket at the opposite end.

I claim:

1. In combination with a racket having a frame, a length of resilient flexible homogenous material of sufficient thickness to act as a bumper and having a portion intermediate its ends of a thickness equal to at least one-third its width, said length being formed adjacent its ends with interengaging elements to permit said length to be looped around the frame of a racket at the upper portion thereof with said interengaging elements holding said loop on said frame thereby providing a sufficient length of the material to protect the frame from damage due to striking an object, said interengaging elements comprising an opening at one end adapted to receive the opposite end of said length therethrough and a protruberance at the opposite end adapted to engage the material of said length adjacent said opening.

2. The combination of claim 1 wherein said length is of rectangular cross section and has a thickness equal to about one-half its width.

3. In combination with a racket having a frame, a length of resilient flexible homogenous material of sufficient thickness to act as a bumper and having a portion intermediate its ends of a thickness equal to at least one-third its width, said length being formed adjacent its ends with interengaging elements to permit said length to be looped around the frame of a racket at the upper portion thereof with said interengaging elements holding said loop on said frame thereby providing a sufficient length of the material to protect the frame from damage due to striking an object, said interengaging elements comprise a socket at one end of said length and a protruberance at the opposite end adapted to be press fitted with said socket.

4. The combination of claim 3 wherein said length is of circular cross section.

* * * * *